United States Patent [19]

Reimann et al.

[11] Patent Number: 4,548,048

[45] Date of Patent: Oct. 22, 1985

[54] DIRECT FIRED ABSORPTION MACHINE FLUE GAS RECUPERATOR

[75] Inventors: Robert C. Reimann, Lafayette, N.Y.; Richard A. Root, Spokane, Wash.

[73] Assignee: The United States of America as represented by the United States Department of Energy, Washington, D.C.

[21] Appl. No.: 670,097

[22] Filed: Nov. 13, 1984

[51] Int. Cl.[4] ..... F25B 27/02

[52] U.S. Cl. ..... 62/238.3; 62/476

[58] Field of Search ..... 62/476, 238.3

[56] References Cited

U.S. PATENT DOCUMENTS

| | | | |
|---|---|---|---|
| 3,254,507 | 6/1966 | Whitlow | 62/476 |
| 3,316,727 | 5/1967 | Bourne | 62/476 X |
| 4,487,036 | 12/1984 | Otoh et al. | 62/476 X |
| 4,501,127 | 2/1985 | Sommers et al. | 62/476 X |

*Primary Examiner*—Lloyd L. King

*Attorney, Agent, or Firm*—Robert H. Kelly

[57] ABSTRACT

A recuperator which recovers heat from a gas, generally the combustion gas of a direct-fired generator of an absorption machine. The recuperator includes a housing with liquid flowing therethrough, the liquid being in direct contact with the combustion gas for increasing the effectiveness of the heat transfer between the gas and the liquid.

2 Claims, 2 Drawing Figures

DIRECT FIRED ABSORPTION MACHINE FLUE GAS RECUPERATOR

STATEMENT AS TO RIGHTS TO INVENTIONS MADE UNDER FEDERALLY SPONSORED RESEARCH AND DEVELOPMENT

The U.S. Government has rights in this invention pursuant to contract No. W-7405-ENG-26 awarded by the U.S. Department of Energy.

BACKGROUND OF THE INVENTION

This invention relates generally to heat recuperators and is particularly related to a flue gas heat recuperating apparatus. More specifically, the present invention relates to a gas-to-liquid heat recuperating system which recuperates heat from the combustion gas of a direct-fired generator of an absorption machine.

In absorption refrigeration systems, it is conventional to supply external heat, usually in the form of steam or direct-fired combustion gas, to the generator in order to heat a weak absorbent solution, typically a lithium bromide solution, and thereby increase the concentration of the absorbent. The operation of a direct-fired absorption refrigeration system is known in the art and will not be described herein in detail. An example of an absorption system is found in U.S. Pat. No. 3,316,727 and is incorporated by reference herein.

Although the present invention can be used in association with a wide range of devices having flue gas recuperating capabilities, it is particularly well suited in conjunction with a generator of an absorption machine having a submerged bundle counterflow heat exchanger in the generator.

The herein described heat recuperator passes exiting flue gas from the combustion tubes of the direct-fired generator through a bubbler chamber filled with a liquid, such as water, to effect more efficient heat transfer which raises the overall efficiency potential of the absorption machine in which it is installed.

SUMMARY OF THE INVENTION

This invention is directed to a recuperator for the flue gas of a direct-fired generator used in a gas-fired absorption machine.

In a preferred embodiment, combustion gas and air are introduced through in-shot burners in the burner assembly and are combusted in the combustion tubes. The combustion tubes include at least one pass, but preferably two passes, an upper pass in an upper solution tray, and a lower pass in a lower solution tray. Both trays include a plurality of baffles which provide a serpentine path for the solution admitted to the upper tray of the generator. The solution is admitted to the upper tray near the discharge end of the combustion tubes and is discharged nearest the initial firing end of the combustion tubes in the lower tray. Accordingly, the flow of the fluids, the combustion gas and solution, is such that counterflow heat transfer is achieved with the hottest combustion gas entering the heat exchanger in proximity with the hottest leaving solution and the coolest combustion gas leaving the heat exchanger in proximity with the coolest entering solution. The exiting flue gas from the combustion tubes is passed through a bubbler chamber filled with a fluid, such as water. The combustion gases which enter the chamber are cooled below their dew point by direct contact with the water and condensation occurs.

It is an object of the present invention to improve the efficiency of an absorption machine by utilizing a recuperator for the combustion gases of a direct-fired generator of an absorption machine.

It is another object of the present invention to recuperate typically lost combustion heat in the flue gas from the combustion tubes of a generator of an absorption machine by passing the exiting flue gas through a liquid filled bubbler chamber.

It is still a further object of the present invention to provide a recuperator which is economical to manufacture, simple in construction, and more efficient than the prior art heat exchangers.

The various features of novelty which characterize the invention are pointed out with particularity in the claims annexed to and forming part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

Figure 1:
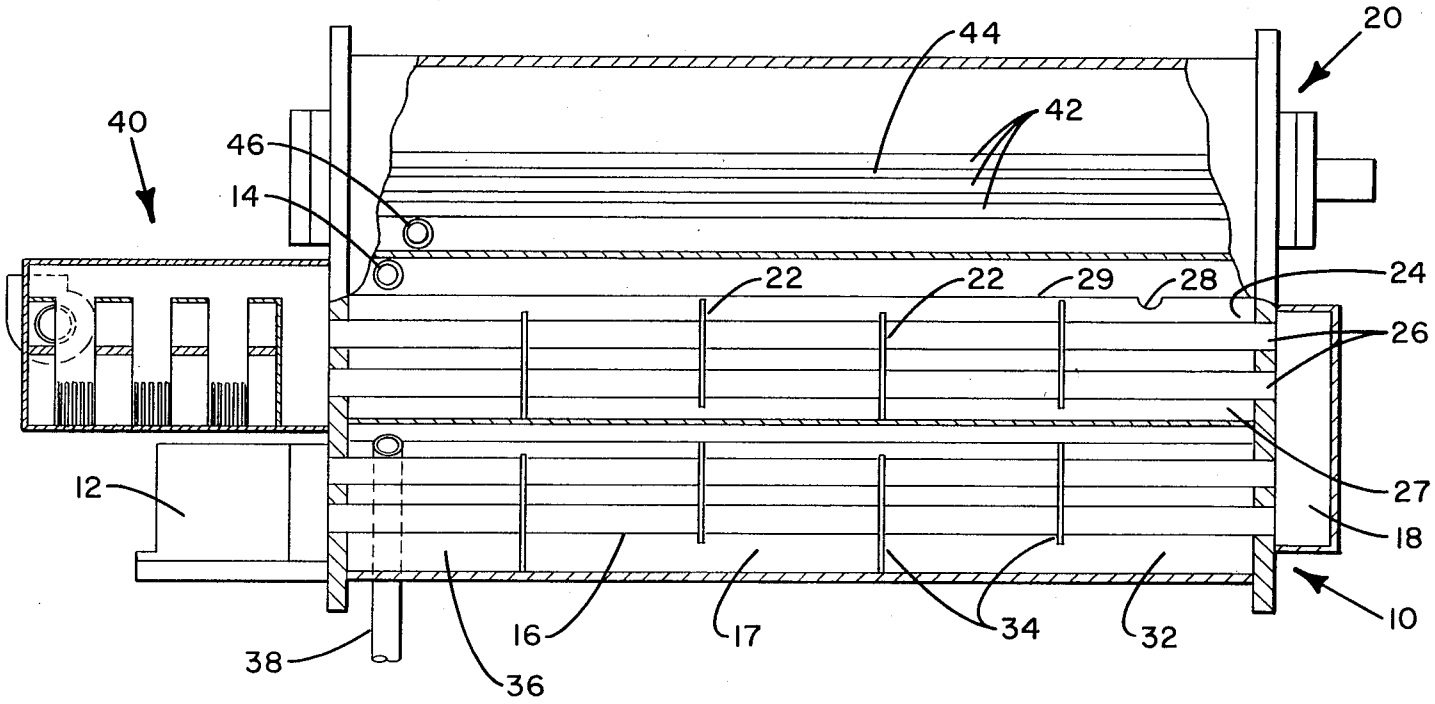
FIG. 1 is an elevational view, partly broken away and partly in section, of a direct-fired generator of an absorption machine utilizing the present invention.

FIG. 1 illustrates a direct-fired generator for an absorption refrigeration system according to the present invention, which, for example, employes water as a refrigerant and lithium bromide as an absorbent solution. Technically, pure lithium bromide is an absorbent and is not an absorbent solution. However, it is customary to refer to the absorbent in an absorption refrigeration system as being a solution because the absorbent may have refrigerant dissolved therein. Therefore, the term "solution" is used throughout this application to denote pure absorbent and absorbent solution. Also, it should be noted that the term "strong solution" is used herein to denote an absorbent solution which has a high concentration of absorbent, such as pure lithium bromide, while the term "weak solution" is used herein to denote an absorbent solution which has a low concentration of absorbent because it has a substantial quantity of refrigerant dissolved therein. Further, it should be noted that refrigerants, other than water, and absorbents, other than lithium bromide, may be used within the scope of this invention and various modifications may be made to the refrigeration system to accommodate these different refrigerants and absorbents.

The absorption refrigeration system, which the generator 10 forms a part thereof, generally further includes an absorber, a condenser, an evaporator, external heat exchangers, a refrigerant pump, and a solution pump.

Generator 10 includes a suitable burner assembly 12 for supplying combustion gas and air to lower combustion tubes 16. The ignited mixture of gas and air flows through the lower combustion tubes 16 located within lower solution tray 17 through connecting chamber 18, then flowing through upper combustion tubes 26, located in upper solution tray 27 to be finally discharged from the upper combustion tubes to the recuperator 40.

The weak solution supplied to the generator 10 through generator inlet line 14, generally flowing from an absorber through an external heat exchanger, enters the upper solution tray 27 and flows through said upper solution tray in a generally parallel relation to the upper combustion tubes 26. The weak solution flows in the upper solution tray, alternately weaving over and under a plurality of baffles 22 until reaching the end baffled section 24. The weak solution entering the upper solution tray is heated by the upper combustion tubes 26 which boils refrigerant out of the weak solution. The refrigerant vapor formed in the upper solution tray passes out of the open top 29 of the solution tray into a condenser 20 where it is cooled and condensed. The relatively hotter, stronger solution flowing into end baffle section 24, flows out overflow port 28, and into the adjacent end baffle section 32 of the lower solution tray 17. This stronger overflow solution then flows generally parallel to the lower combustion tubes 16, alternately over and under the lower baffles 34 in a serpentine fashion, to the lower front baffle section 36. In the lower front baffle section 36, the relatively hot, strong concentrated solution overflows the lower solution tray and passes through a discharge passageway 38 into the absorber.

The refrigerant vapor formed in the generator flows into the condenser 20, which has a trough like heat exchanger having a plurality of condenser tubes 42 contained within an open trough like shell 44, where this refrigerant vapor is cooled and condensed. The liquid refrigerant condensed in the condenser 20 passes through a refrigerant liquid passage 46 into the evaporator. A fluid medium, such as water, passes through the condenser tubes 42 to condense the liquid refrigerant in the condenser.

Figure 2:
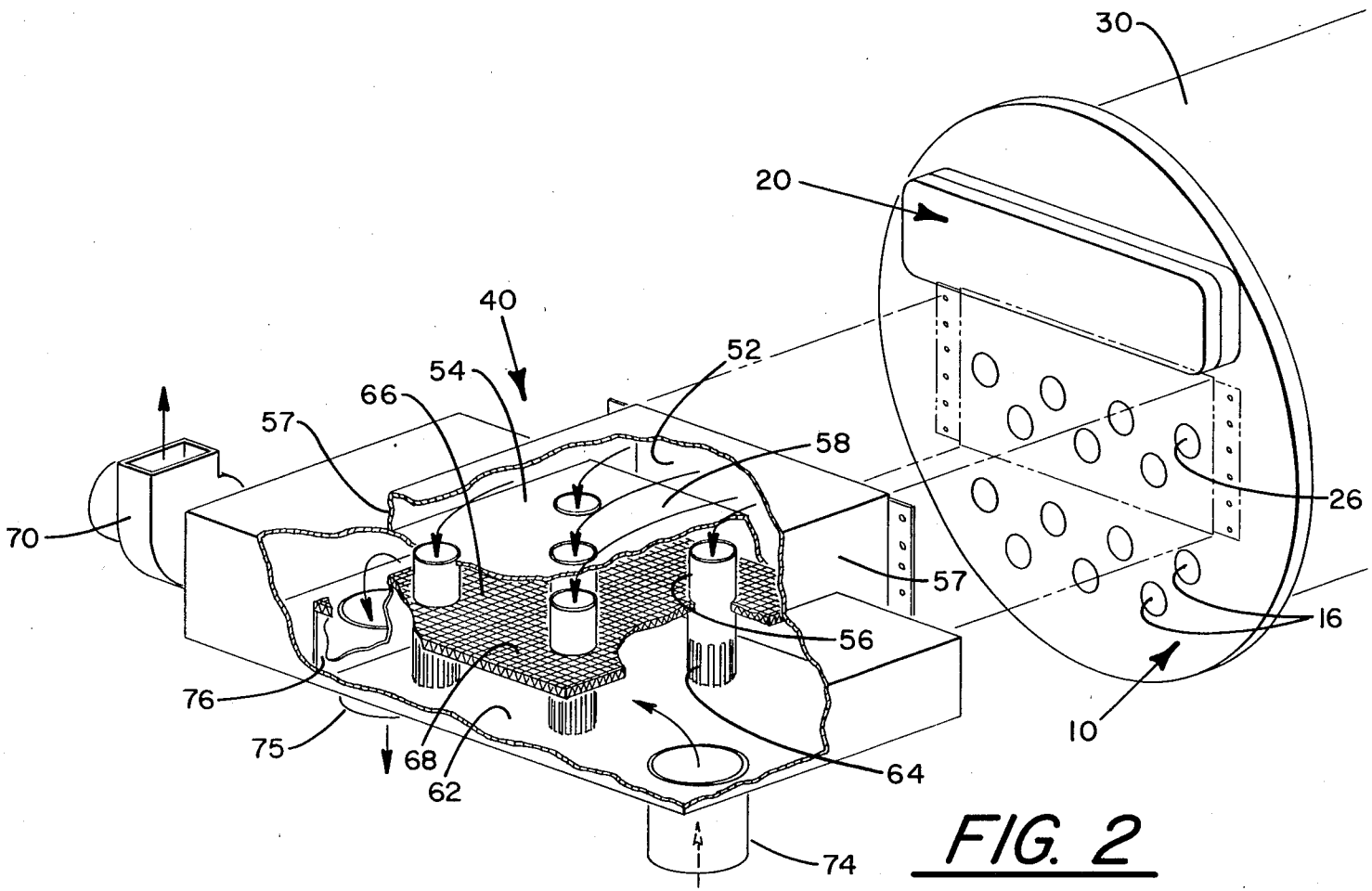
FIG. 2 a perspective view, partly broken away of the flue gas recuperator of the present invention.

Referring to FIG. 2, it may be seen that the generator 10 and condenser 20 sections are included within a single shell 30, but it will be appreciated that other configurations will be satisfactory. The burner assembly supplies an ignited mixture of gas and air into lower combustion tubes 16 to heat weak solution which is supplied to the generator from the absorber through an inlet line in the generator. The weak solution is heated in the upper solution tray 27 and lower solution tray 17 to boil off refrigerant vapor and to thereby concentrate the weak solution. Refrigerant vapor rises upwardly to the condenser section 20 which is conveniently located in the same shell 30 as the generator 19 and comprises a plurality of heat exchange condenser tubes 42. The refrigerant vapor is condensed to liquid refrigerant in said condenser section. Liquid refrigerant passes from the condenser section 20 through refrigerant liquid passage 46 to the evaporator.

Moreover, when the combustion gases leave the upper combustion tubes 26 they enter the recuperator 40 through inlet 52, where they are drawn through gas passageway 54 and then down through distribution tubes 56. The distribution tubes 56 are supported by tube sheet 58 having apertures therethrough for mating with the tubes 56. The tube sheet 58 also mates with the side and front walls 57 of gas passageway 54 to separate the combustion gases from the liquid in the recuperator. After being drawn down the distribution tubes 56, the combustion gases flow through openings 64 in the distribution tubes and displace the liquid, which may be water, contained in the bubbler tank 62. The combustion gases then bubble up through the liquid to upper collection chamber 66 which is separated from the bubbler tank by demister screen 68. The exhaust blower 70, connected to the upper collection chamber 66 of the recuperator, which provides the induced draft for combustion as well as the static pressure to overcome the liquid head of the bubbler tank 62, then exhausts the final combustion products to a flue (not shown).

To effect continuous heat transfer and dilution of the products of combustion dissolved in the liquid medium of the recuperator, a continuous flow of liquid enters bubbler tank 62 through inlet conduit 74. After being in direct contact and in heat exchange relationship with the combustion gases in the bubbler tank 62, the water passes upward through anti-turbulence demister screen 68, overflows weir 76 into end chamber 78, and flows out conduit 75 to an appropriate load. Accordingly, the combustion gases that enter the recuperator 40 are cooled below the dew point by direct contact with the liquid medium and condensation occurs. The heat transfer effectiveness of the recuperator can approach 100% and the overall efficiency of the generator is improved to 90% and above.

What is claimed is:

1. A recuperator for an absorption refrigeration system having a direct-fired generator, a condenser, an absorber, and an evaporator, the recuperator comprising:

a housing secured to the direct fired generator;

a first inlet means and first outlet means formed in said housing, said first inlet means having side walls, a top wall, and a bottom wall, one of said side walls having an aperture therethrough to receive combustion gas flowing from the direct-fired generator, the bottom wall having aperture means therethrough for discharging the received combustion gas, said first outlet means including a blower for drawing the combustion gas from said first inlet means through said housing to said outlet means;

a means for conducting a cooling fluid through said housing, said cooling fluid conducting means defining a flow path having an inlet, an outlet, side walls, a top wall, a bottom wall, and an intermediate anti-turbulence screen disposed between said top wall and said bottom wall and generally parallel thereto, whereby two opposite side walls have a partition perpendicular therebetween defining a weir spaced between said bottom wall and said anti-turbulence screen to divert said cooling fluid from said inlet through said anti-turbulence screen; and conduit means sealingly aligned with the aperture means of the bottom wall of said first inlet means, said conduit means having an aperture formed therein to define a flow path for the combustion gas to flow from said first inlet means through said cooling fluid and out said first outlet means to a flue.

2. A recuperator as set forth in claim 1 wherein said aperture formed in said conduit means is a longitudinal slot along the axis of said conduit means spaced between said anti-turbulence screen and said bottom wall of said cooling fluid conduction means.

* * * * *